US007631633B2

(12) United States Patent
Sasaki

(10) Patent No.: US 7,631,633 B2
(45) Date of Patent: Dec. 15, 2009

(54) CAPACITOR DISCHARGE IGNITION DEVICE FOR ENGINE

(75) Inventor: Kouji Sasaki, Numazu (JP)

(73) Assignee: Kokusan Denki Co., Ltd., Shizuoka (JP)

( * ) Notice: Subject to any disclaimer, the term of this patent is extended or adjusted under 35 U.S.C. 154(b) by 361 days.

(21) Appl. No.: 11/836,888

(22) Filed: Aug. 10, 2007

(65) Prior Publication Data

US 2009/0272354 A1 Nov. 5, 2009

(30) Foreign Application Priority Data

Aug. 11, 2006 (JP) ..... 2006-220277

(51) Int. Cl.
*F02P 5/00* (2006.01)

(52) U.S. Cl. ..... 123/406.57; 123/599; 123/618; 123/644

(58) Field of Classification Search ..... 123/406.57, 123/596, 599, 600, 618, 644
See application file for complete search history.

(56) References Cited

U.S. PATENT DOCUMENTS 4,308,848 A * 1/1982 Pfaff et al. ..... 123/618
4,397,290 A * 8/1983 Tanaka et al. ..... 123/618
4,757,797 A * 7/1988 Bengtsson ..... 123/406.57
5,433,184 A * 7/1995 Kinoshita et al. ..... 123/406.57
6,138,653 A * 10/2000 Juffinger ..... 123/598
6,336,448 B1 * 1/2002 Furuhata et al. ..... 123/644

FOREIGN PATENT DOCUMENTS

JP 05-052168 3/1993

* cited by examiner

*Primary Examiner*—Stephen K Cronin
*Assistant Examiner*—Anthony L Bacon
(74) *Attorney, Agent, or Firm*—Pearne & Gordon LLP

(57) ABSTRACT

A capacitor discharge ignition device for an engine including: an exciter coil provided in a magneto generator driven by the engine; a voltage increasing circuit that increases an induced voltage of the exciter coil; a capacitor charged by an output voltage of the voltage increasing circuit; and a discharge switch that is turned on at ignition timing of the engine and discharges charges in the capacitor through a primary coil of the ignition coil, wherein the ignition device further includes a voltage increasing control portion that controls the voltage increasing circuit so as to increase an output voltage of the voltage increasing circuit when a rotational speed of the engine is a set value or less, and limit the output voltage of the voltage increasing circuit when the rotational speed of the engine exceeds the set value.

7 Claims, 3 Drawing Sheets

Fig. 4A
Fig. 4B
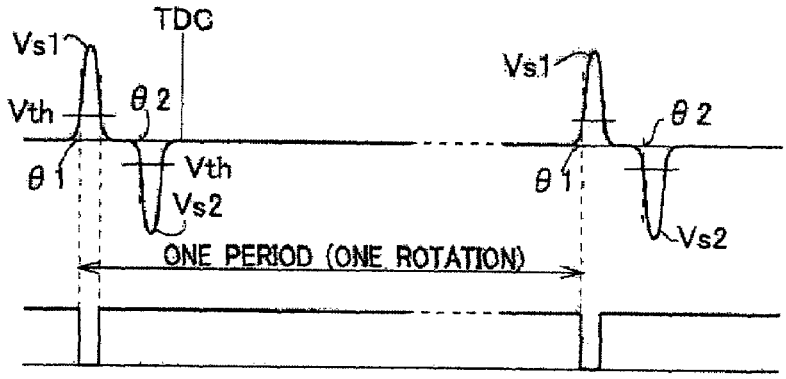
Fig. 5
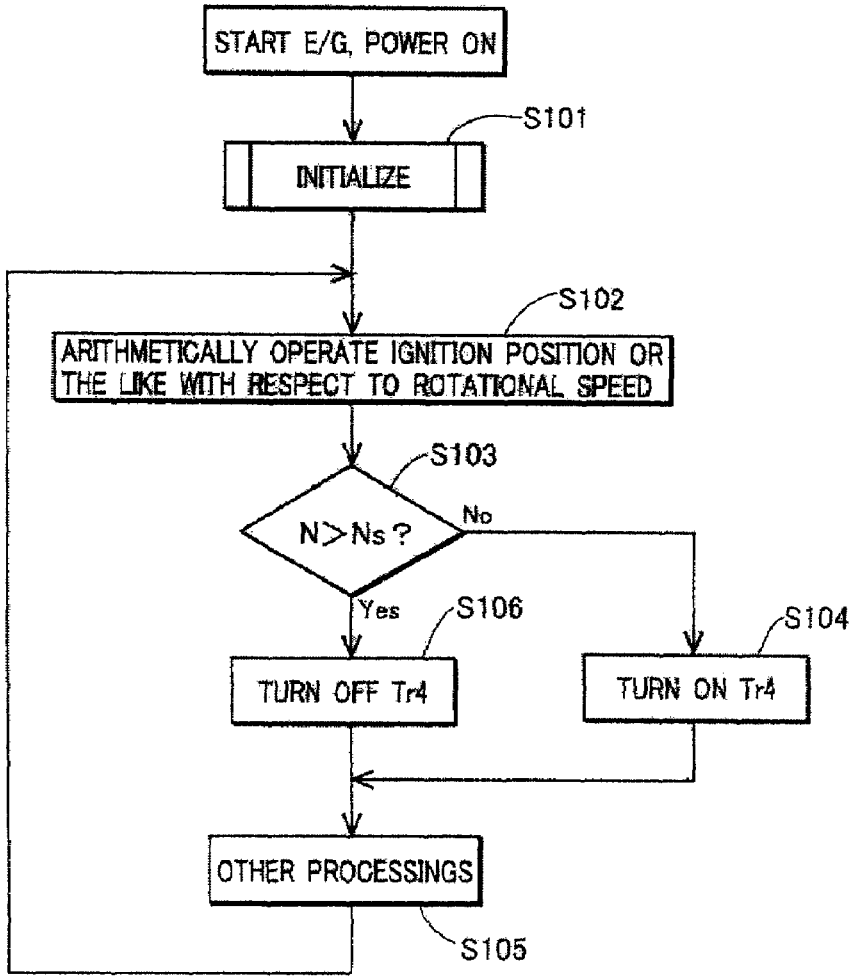

CAPACITOR DISCHARGE IGNITION DEVICE FOR ENGINE

TECHNICAL FIELD OF THE INVENTION

The present invention relates to a capacitor discharge ignition device that generates a high voltage for igniting an engine using an exciter coil provided in a magneto generator driven by the engine as a power supply.

PRIOR ART OF THE INVENTION

As well known, a capacitor discharge ignition device is comprised of a capacitor provided on a primary side of an ignition coil, a charging power supply for charging the capacitor, a capacitor discharge switch that is turned on when receiving an ignition signal and discharges charges in the capacitor through a primary coil of the ignition coil, and an ignition control portion that provides the ignition signal to the capacitor discharge switch at ignition timing of the engine.

In such an ignition device, the charges in the capacitor are discharged through the primary coil of the ignition coil at the ignition timing of the engine to induce a high voltage for ignition in a secondary coil of the ignition coil, and the high voltage is applied to an ignition plug mounted to a cylinder of the engine to cause an ignition operation.

As a charging power supply for charging an ignition capacitor, an exciter coil provided in a magneto generator driven by the engine, or a DC-DC converter that increases an output voltage of a battery are used. The present invention is applied to a capacitor discharge ignition device of the type using an exciter coil as a charging power supply.

Since the ignition capacitor needs to be charged to at least on the order of 200V, a charging power supply comprised so as to charge the capacitor with an output voltage of the exciter coil needs to use a coil with many turns as the exciter coil. Thus, when the charging power supply is comprised of the exciter coil only, the size of a generator is increased, or space for providing other magneto coils in a magneto generator is reduced.

Thus, as disclosed in Japanese Patent Application Laid-Open Publication No. 5-52168, a capacitor discharge ignition device is used in which a charging power supply is comprised of an exciter coil and a voltage increasing circuit that increases an output voltage of the exciter coil to charge an ignition capacitor with an output voltage of the voltage increasing circuit.

The voltage increasing circuit includes a voltage increasing switch connected in parallel with the exciter coil, brings the voltage increasing switch into conduction to short-circuit the exciter coil when the exciter coil induces a voltage of one half cycle, and interrupts the voltage increasing switch when the output voltage of the exciter coil reaches a certain level to interrupt a short-circuit current passing through the exciter coil. When the short-circuit current passing through the exciter coil is interrupted, a high voltage having a polarity for attempting to continuously pass the short-circuit current having passed until then is induced in the exciter coil. The induced voltage is applied to the ignition capacitor to allow the ignition capacitor to be charged to a sufficiently high voltage of 200 V or more.

As disclosed in Japanese Patent Application Laid-Open Publication No. 5-52168, in the ignition device including the above described voltage increasing circuit, rising of the voltage induced in the exciter coil becomes faster with increasing rotational speed of the engine, and thus the voltage induced when the short-circuit current of the exciter coil is interrupted is increased with increasing rotational speed of the engine. Thus, when the voltage increasing circuit is comprised so as to charge the ignition capacitor to a predetermined voltage during low speed rotation of the engine, a charging voltage of the ignition capacitor becomes excessive in middle and high speed rotation areas of the engine.

In order to solve this problem, it can be supposed that a voltage limiting circuit is provided that maintains a short-circuit across an exciter coil when a voltage across an ignition capacitor exceeds a set trigger level to prevent an interruption of a short-circuit current, thereby preventing a charging voltage of the ignition capacitor from becoming excessive.

However, providing such a voltage limiting circuit causes a large short-circuit current to pass from the exciter coil through the voltage limiting circuit during middle and high speed rotation of the engine, and thus the voltage limiting circuit wastes energy to increase heat generation from the exciter coil.

Thus, in the capacitor discharge ignition device disclosed in Japanese Patent Application Laid-Open Publication No. 5-52168, a circuit is provided that uses a transistor as the voltage increasing switch, increases a base current of the transistor to increase a short-circuit current when a current passing through the voltage increasing switch is a reference value or less, and reduces the base current of the transistor when the current passing through the voltage increasing switch exceeds the reference value to reduce the short-circuit current, thereby allowing a high voltage to be induced in the exciter coil during low speed rotation of the engine.

In the capacitor discharge ignition device disclosed in Japanese Patent Application Laid-Open Publication No. 5-52168, arithmetical operation means for arithmetically operating interruption timing of the voltage increasing switch required for making the voltage induced in the exciter coil in the interruption of the voltage increasing switch equal to a set value with respect to the output voltage of the exciter coil and the rotational speed of the engine, and a circuit that interrupts the voltage increasing switch when the interruption timing arithmetically operated by the arithmetical operation means is detected are also provided to allow a substantially constant voltage to be induced in the exciter coil from during low speed rotation to during high speed rotation of the engine.

Comprised as described above, the substantially constant voltage can be induced in the exciter coil from during low speed rotation to during high speed rotation of the engine without providing the voltage limiting circuit that short-circuits an excess output of the exciter coil, thereby preventing wasting energy and preventing heat generation from the exciter coil.

In the capacitor discharge ignition device disclosed in Japanese Patent Application Laid-Open Publication No. 5-52168, the arithmetical operation means for arithmetically operating the interruption timing of the voltage increasing switch with respect to the output voltage of the exciter coil and the rotational speed of the engine, and means for detecting the interruption timing arithmetically operated by the arithmetical operation means need to be constituted by a microprocessor, which increases the number of processings executed by the microprocessor for controlling the voltage increasing circuit, thereby inevitably increasing processing time required for control of the voltage increasing circuit.

This limits processing time required for other controls such as ignition timing control or fuel injection amount control, which have to be simplified.

SUMMARY OF THE INVENTION

An object of the present invention is to provide a capacitor discharge ignition device for an engine that prevents insufficient charging of an ignition capacitor during low speed rotation of the engine, and maintains a substantially constant output voltage of a voltage increasing circuit without wasting energy during middle and high speed rotation of the engine to prevent a charging voltage of the ignition capacitor from becoming excessive, without complex processings being performed by a microprocessor.

The present invention is directed to a capacitor discharge ignition device for an engine including: an exciter coil provided in a magneto generator driven by the engine; a voltage increasing circuit that increases an output voltage of one half cycle of the exciter coil; an ignition capacitor charged by an output voltage of the voltage increasing circuit; a capacitor discharge switch that becomes an on-state when receiving an ignition signal and discharges charges in the ignition capacitor through a primary coil of the ignition coil; and an ignition control portion that provides an ignition signal to the capacitor discharge switch at ignition timing of the engine.

In the present invention, the voltage increasing circuit includes: a voltage increasing switch that is comprised of a switch element that can be an on-state while receiving a drive signal, is connected in parallel with the exciter coil, and can be the on-state to pass a short-circuit current through the exciter coil when the exciter coil generates the output voltage of one half cycle; a voltage increasing switch drive circuit that provides the drive signal to the voltage increasing switch; a first shunt resistor for current detection connected in series with the voltage increasing switch; an interruption control switch that is provided so as to allow the drive signal to be provided to the voltage increasing switch when the interruption control switch is in an off-state and bypass the drive signal from the voltage increasing switch to interrupt the voltage increasing switch when the interruption control switch is in an on-state, and receives a trigger signal and is turned on when a voltage across the first shunt resistor reaches a set trigger level; a second shunt resistor connected in parallel across the first shunt resistor through a resistance value changeover switch; and a switch control portion that controls the resistance value changeover switch so as to maintain the resistance value changeover switch in an on-state when a rotational speed of the engine is a set value or less, and maintain the resistance value changeover switch in an off-state when the rotational speed exceeds the set value.

When the voltage increasing circuit is comprised as described above, the resistance value changeover switch becomes the on-state during low speed rotation of the engine (when the rotational speed is the set value or less), and thus the second shunt resistor is connected in parallel across the first shunt resistor. When the second shunt resistor is connected in parallel across the first shunt resistor, the voltage across the first shunt resistor does not reach the trigger level unless a higher current than a current that causes the voltage across the first shunt resistor to reach the trigger level in separation of the second shunt resistor passes through the voltage increasing switch, and thus an apparent trigger level of the interruption control switch can be increased to increase a current interruption value in the interruption of the voltage increasing switch. Thus, the voltage induced in the exciter coil during low speed rotation of the engine can be increased to charge the ignition capacitor to a sufficiently high voltage, thereby increasing ignition performance during low speed rotation and increasing startability of the engine and stability of rotation during low speed rotation.

When the rotational speed of the engine increases and exceeds the set value, the second shunt resistor is separated from the first shunt resistor, and thus a current required to be passed through the voltage increasing switch for causing the voltage generated across the first shunt resistor to reach the trigger level can be made lower than in the case where the second shunt resistor is connected in parallel with the first shunt resistor. Thus, during middle and high speed rotation of the engine, the apparent trigger level of the interruption control switch can be reduced to limit the current interruption value in the interruption of the voltage increasing switch, thereby preventing an increase in the induced voltage of the exciter coil and preventing the charging voltage of the ignition capacitor from becoming excessive. When the induced voltage of the exciter coil is limited during middle and high speed rotation of the engine, an excess output of the exciter coil is not short-circuited, thereby preventing wasting energy and preventing the charging voltage of the ignition capacitor from becoming excessive.

In order to perform sufficient charging of the ignition capacitor to increase ignition performance and increase startability of the engine when the rotational speed of the engine is extremely low, a peak trigger circuit is preferably further provided that provides a trigger signal to the interruption control switch when the output voltage of one half cycle of the exciter coil reaches its peak.

Comprised as described above, when the output voltage of one half cycle of the exciter coil reaches its peak during extremely low speed rotation in which the rotational speed of the engine is the set value or less, the short-circuit current of the exciter coil is interrupted, and thus an interruption value of the short-circuit current can be increased to increase the voltage induced in the exciter coil. Thus, the ignition capacitor can be charged to a sufficiently high voltage to increase ignition performance and increase startability of the engine during extremely low speed rotation.

As described above, according to the present invention, the second shunt resistor connected in parallel across the first shunt resistor through the resistance value changeover switch, and the switch control portion that controls the resistance value changeover switch according to the rotational speed so as to maintain the resistance value changeover switch in the on-state when the rotational speed of the engine is the set value or less, and maintain the resistance value changeover switch in the off-state when the rotational speed exceeds the set value are provided, and the second shunt resistor is connected in parallel across the first shunt resistor during low speed rotation of the engine, thereby increasing the interruption value of the current in the interruption of the voltage increasing switch. Thus, the output voltage of the voltage increasing circuit can be increased during low speed rotation of the engine to charge the ignition capacitor to a sufficiently high voltage, and the ignition performance during low speed rotation can be increased to increase startability of the engine and stability of rotation during low speed rotation.

Also, according to the present invention, when the rotational speed of the engine increases and exceeds the set value, the second shunt resistor is separated from the first shunt resistor to limit the current interruption value in the interruption of the voltage increasing switch and prevent the increase in the voltage output by the voltage increasing circuit without the output of the exciter coil being short-circuited, thereby preventing wasting energy and preventing overcharge of the ignition capacitor during middle and high speed rotation of the engine.

BRIEF DESCRIPTION OF THE DRAWINGS

The above and other objects and features of the invention will be apparent from the detailed description of the preferred embodiment of the invention, which is described and illustrated with reference to the accompanying drawings, in which;

FIGS. 4A and 4B are waveform charts showing a waveform of a pulse signal output by the signal coil, and a waveform of a signal obtained by passing the pulse signal through a waveform shaping circuit in the embodiment in FIG. 1; and FIG. 5 is a flowchart showing essential portions of an algorithm of a main routine of a program executed by the microprocessor in the embodiment of the present invention.

DETAILED DESCRIPTION OF THE PREFERRED EMBODIMENTS

Now, a preferred embodiment of the present invention will be described in detail with reference to the drawings. The present invention may be applied to an ignition device for igniting an engine having any number of cylinders, but for simplicity of description, the engine has a single cylinder in the embodiment described below.

Figure 1:
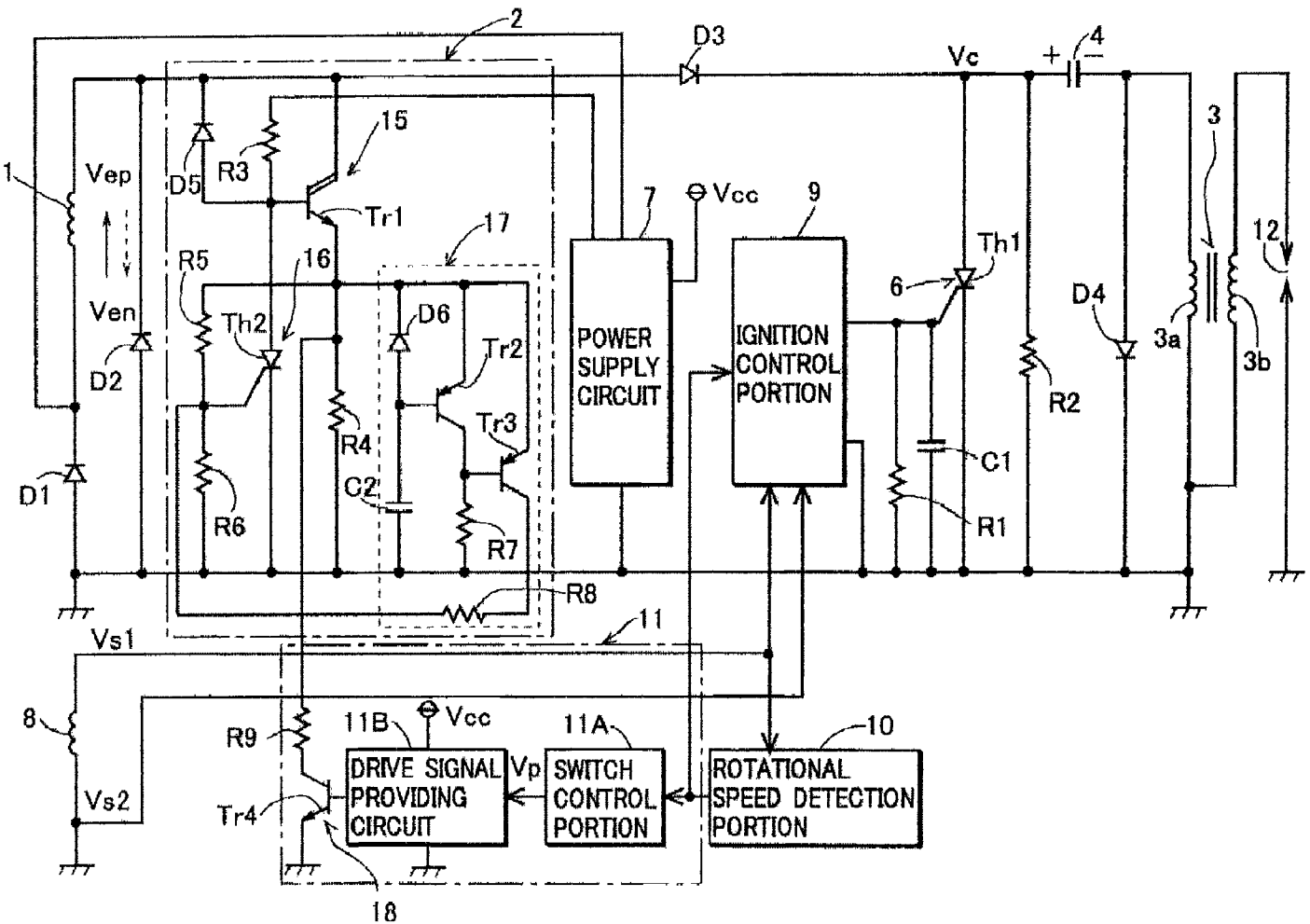
FIG. 1 is a schematic circuit diagram of a construction of an embodiment of the present invention.

FIG. 1 shows a construction of the embodiment of the present invention. In FIG. 1, a reference numeral 1 denotes an exciter coil provided in a magneto AC generator mounted to an unshown engine, 2 denotes a voltage increasing circuit that increases an output voltage of one half cycle of the exciter coil 1, 3 denotes an ignition coil including a primary coil 3*a* and a secondary coil 3*b* each having one grounded end, 4 denotes an ignition capacitor provided on a primary side of the ignition coil and charged by an output of the voltage increasing circuit 2, 6 denotes a discharge switch that becomes an on-state when receiving an ignition signal and discharges charges in the ignition capacitor 4 through the primary coil 3*a* of the ignition coil, and 7 denotes a power supply circuit that converts the output voltage of the exciter coil 1 into a certain DC voltage. 8 denotes a signal coil that is provided in an unshown signal generator mounted to the engine, and generates a pulse signal at a predetermined crank angle position of the engine, 9 denotes an ignition control portion that provides an ignition signal to the discharge switch 6 at ignition timing of the engine, 10 denotes a rotational speed detection portion that detects a rotational speed of the engine based on rotation information of the engine obtained from an output of the signal coil 8, and 11 denotes a voltage increasing control portion that performs control to change voltage increasing performance of the voltage increasing circuit.

One end of the exciter coil 1 is connected to a cathode of a diode D1 having a grounded anode, and a diode D2 having an anode directed to the 10 ground is connected across a series circuit of the exciter coil 1 and the diode D1. The other end of the exciter coil 1 is connected to one end of the ignition capacitor 4 through a diode D3 having an anode directed to the other end of the exciter coil, and the other end of the ignition capacitor 4 is connected to a non-ground terminal of the primary coil 3*a* of the ignition coil 3.

A thyristor Th1 that constitutes the discharge switch 6 is connected between one end of the ignition capacitor 4 and the ground with a cathode thereof directed to the ground, and resistance R1 and a capacitor C1 are connected in parallel between a gate and the cathode of the thyristor. Protective resistance R2 is connected across the thyristor Th1, and a diode D4 is connected across the primary coil 3*a* of the ignition coil with a cathode thereof directed to the ground. A non-ground terminal of the secondary coil 3*b* of the ignition coil is connected to a non-ground terminal of an ignition plug 12 mounted to the cylinder of the engine through a high-tension code.

The exciter coil 1 generates an AC voltage constituted by an output voltage Vep of a positive half cycle in the direction of the shown solid arrow, and an output voltage Ven of a negative half cycle in the direction of the shown broken arrow in synchronization with rotation of the engine. A capacitor charging circuit for charging the ignition capacitor 4 is comprised of a circuit of the exciter coil 1—the diode D3—the ignition capacitor 4—the diode D4 and the primary coil 3*a*—the diode D1—the exciter coil 1.

The power supply circuit 7 converts the output voltage Ven of the negative half cycle (a half cycle of the other polarity) of the exciter coil 1 input through the diode D2 into a certain (for example, 5 V) DC voltage Vcc suitable for driving a microprocessor or the like that constitutes part of components of the ignition control portion 9 and the voltage increasing control portion 11 or the like. The power supply circuit is comprised of, for example, a power supply capacitor charged by the output voltage Ven of the negative half cycle of the exciter coil, and a control circuit that performs control to maintain a constant voltage across the power supply capacitor.

As shown in FIG. 4A, the signal coil 8 generates a first pulse signal Vs1 at a reference crank angle position θ1 set in a position sufficiently advanced from a top dead center position TDC which is a crank angle position at the time of a piston of the engine reaching the top dead center, and generates a second pulse signal Vs2 at a crank angle position θ2 near the top dead center position TDC.

Figure 3:
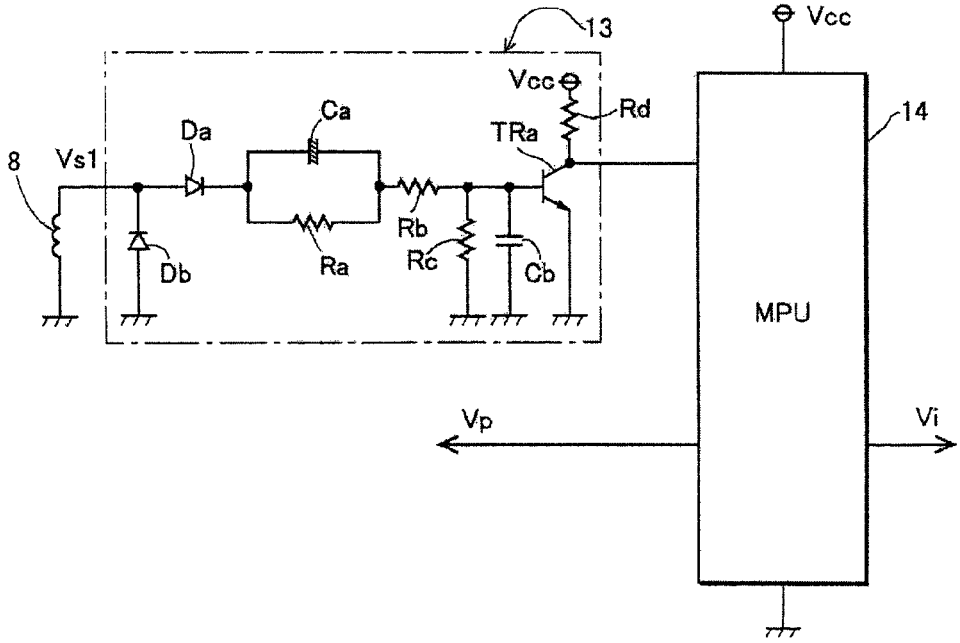
FIG. 3 is a schematic circuit diagram of a construction of a section where an output of a signal coil is input to a microprocessor in the embodiment in FIG. 1.

As shown in FIG. 3, the first pulse signal Vs1 is provided to a microprocessor 14 through a known waveform shaping circuit 13 comprised of a transistor TRa, diodes Da and Db, resistances Ra to Rd, and capacitors Ca and Cb. The waveform shaping circuit 13 is provided for converting the pulse signal Vs1 into a signal identifiable by the microprocessor, and in this example, the transistor TRa is turned on while the pulse signal Vs1 is a threshold level Vth or more to convert the pulse signal Vs1 into a rectangular wave signal as shown in FIG. 4B. The microprocessor detects trailing of the rectangular wave signal to identify the generation of the pulse signal Vs1 (the agreement of the crank angle position with the reference crank angle position θ1).

The microprocessor 14 executes a predetermined program stored in a ROM to constitute the rotational speed detection portion 10 and the ignition control portion 9, and also constitute a switch control portion 11A of a voltage increasing control portion 11 described later.

The rotational speed detection portion 10 measures time between the last input of the pulse signal Vs1 and this input of the pulse signal Vs1 for each input of the pulse signal Vs1 with a timer, calculates a period of detection of the pulse signal Vs1, and arithmetically operates the rotational speed of the engine from the period (time required for one rotation of a crankshaft).

The ignition control portion 9 is comprised of ignition timing arithmetical operation means for arithmetically operating ignition timing of the engine with respect to the rotational speed detected by the rotational speed detection portion 10, and ignition signal generation means for outputting an ignition signal Vi in detection of the ignition timing arithmetically operated by the ignition timing arithmetical operation means. The ignition timing is arithmetically operated in the form of time data measured by the timer while the crankshaft rotates from the reference crank angle position to a crank angle position for ignition (an ignition position) at the current rotational speed. The microprocessor sets the time data arithmetically operated by the ignition timing arithmetical operation means in the timer to start the measurement when the pulse signal Vs1 is input, and provides the ignition signal Vi to the thyristor Th1 that constitutes the capacitor discharge switch 6 when the timer completes the measurement of the time data.

The voltage increasing circuit 2 includes an exciter short-circuiting transistor Tr1 comprised of a plurality of NPN Darlington-connected transistors, and a collector of the transistor is connected to the other end of the exciter coil 1. A base of the transistor Tr1 is connected to an output terminal of the power supply circuit 7 through resistance R3, and an emitter of the transistor Tr1 is grounded through a first shunt resistor R4 for detecting a short-circuit current. In this example, the transistor Tr1 constitutes a voltage increasing switch 15 connected in parallel with the exciter coil 1, and the first shunt resistor R4 is connected in series with the voltage increasing switch 15.

A diode D5 having an anode directed to the base of the transistor Tr1 is connected between the collector and the base of the transistor Tr1, and a resistance voltage divider circuit comprised of a series circuit of resistances R5 and R6 is connected between the emitter of the transistor Tr1 and the ground. A thyristor Th2 having an anode directed to the base of the transistor is connected between the base of the transistor Tr1 and the ground, and a gate of the thyristor Th2 is connected to a connecting point of the resistances R5 and R6 (a voltage dividing point of the voltage divider circuit).

In this example, a voltage increasing switch drive circuit that provides a drive signal (a base current) to the transistor Tr1 that constitutes a voltage increasing switch is comprised of the power supply circuit 7 and the resistance R3. The voltage increasing switch 15 can be an on-state while receiving the drive signal, and becomes the on-state to pass a short-circuit current through the exciter coil 1 when the exciter coil 1 generates the output voltage of a positive half cycle.

An interruption control switch 16 is comprised of the thyristor Th2, and an interruption control switch trigger circuit that provides a trigger signal to the interruption control switch 16 when a voltage across the first shunt resistor R4 reaches a set trigger level is comprised of the resistance voltage divider circuit comprised of the resistances R5 and R6.

The interruption control switch 16 is provided so as to allow the drive signal to be provided to the voltage increasing switch 15 when the interruption control switch is in an off-state and bypass the drive signal from the voltage increasing switch 15 to interrupt the voltage increasing switch 15 when the interruption control switch is in an on-state.

The thyristor Th2 that constitutes the interruption control switch 16 receives the trigger signal and is turned on when the short-circuit current of the exciter coil passing through the voltage increasing switch 15 reaches a predetermined level and the voltage across the first shunt resistor R4 reaches the set trigger level.

The thyristor Th2 is turned off with an anode current thereof being attenuated to less than a holding current when the voltage across the first shunt resistor R4 becomes less than the trigger level, then the exciter coil 1 generates the output voltage Ven of the negative half cycle, and the current passing from the power supply circuit 7 through the resistance R3 to the thyristor Th2 is bypassed from the thyristor 16 through the diode D5 and the exciter coil 1.

When the short-circuit current of the exciter coil passing through the voltage increasing switch 15 reaches the predetermined level, and the voltage across the first shunt resistor R4 reaches the trigger level, the thyristor Th2 is turned on, and thus the base current (the drive signal) provided to the transistor Tr1 that constitutes the voltage increasing switch 15 is bypassed from the transistor Tr1 through the thyristor Th2. Thus, the transistor Tr1 is interrupted to interrupt the short-circuit current of the exciter coil 1. When the short-circuit current of the exciter coil is interrupted, a high voltage (a voltage having the same polarity as the output voltage of the positive half cycle) for continuously passing the short-circuit current having passed until then is induced in the exciter coil 1. The induced voltage thus increased of the exciter coil is applied to the ignition capacitor 4 through the above-mentioned charging circuit, and thus the ignition capacitor 4 is charged to the shown polarity.

In the embodiment, an emitter of a PNP transistor Tr2 is connected to the emitter of the transistor Tr1, and a collector of the transistor Tr2 is grounded through resistance R7. A diode D6 having an anode directed to a base of the transistor Tr2 is connected between the emitter and the base of the transistor Tr2, and a peak detection capacitor C2 is connected between the base of the transistor Tr2 and the ground. The emitter and the base of the transistor Tr2 are connected to an emitter and a base, respectively, of a PNP transistor Tr3, and the transistor Tr3 is turned off and on when the transistor Tr2 is turned on and off, respectively. The collector of the transistor Tr3 is connected to the gate of the thyristor Th2 through resistance R8, and the trigger signal is provided to the thyristor Th2 through the resistance R8 when the transistor Tr2 is turned off and the transistor Tr3 is turned on.

In this example, a peak trigger circuit 17 is comprised of the transistors Tr2 and Tr3, the peak detection capacitor C2, the diode D6, and the resistance R7. In the peak trigger circuit, the current passes through the emitter and the base of the transistor Tr2 and the capacitor C2 when the transistor Tr1 that constitutes the voltage increasing switch 15 is turned on, and the transistor Tr2 is turned on. Since the transistor Tr3 is off while the transistor Tr2 is turned on, no trigger signal is provided to the thyristor Th2 through the transistor Tr3 and the resistance R8. When the output voltage Vep of the positive half cycle of the exciter coil 1 reaches its peak, the charging of the capacitor C2 is completed, and thus no base current passes through the transistor Tr2, and the transistor Tr2 is turned off. Thus, the transistor Tr3 is turned on, and the trigger signal is provided to the thyristor Th2 through the resistance R8 to turn on the thyristor Th2. The charges in the capacitor C2 are discharged through the diode D6, the transistor Tr3, the resistance R8, and between the gate and the cathode of the thyristor Th2 when the transistor Tr3 is turned on.

In the embodiment, a second shunt resistor R9 is connected in parallel across the first shunt resistor R4 through a resistance value changeover switch 18. The shown resistance value changeover switch 18 is comprised of an NPN transistor Tr4 having a grounded emitter, and the second shunt resistor R9 is connected between a collector of the transistor Tr4 and the emitter of the transistor Tr1.

In order to control the resistance value changeover switch 18, the switch control portion 11A is provided that controls the resistance value changeover switch 18 according to the rotational speed detected by the rotational speed detection portion 10 so as to maintain the resistance value changeover switch 18 in an on-state when the rotational speed N of the engine detected by the rotational speed detection portion 10 is a set value Ns or less, and maintain the resistance value changeover switch 18 in an off-state when the rotational speed N exceeds the set value Ns. The set value Ns of the rotational speed is set to a value that provides a boundary between a low speed rotation area and a middle speed rotation area of the engine. The set value Ns is set appropriately according to specifications and use or the like of the engine.

A drive signal providing circuit 11B that provides a drive signal to the resistance value changeover switch 18 is provided, and when the switch control portion 11A generates an on-command signal Vp, the drive signal (the base current of the transistor Tr4 in this example) is provided from the power supply circuit 7 through the drive signal providing circuit 11B to the resistance value changeover switch 18.

FIG. 5 shows essential portions of an algorithm of a main routine executed by the microprocessor for constituting the switch control portion 11A. According to the algorithm, after an engine starting power supply is turned on, first in Step S101, each portion is initialized, and the on-command signal Vp is generated in the process of initialization to turn on the transistor Tr4. Then in Step S102, an arithmetical operation of ignition timing or the like is performed with respect to the rotational speed N arithmetically operated in a different routine for constituting the rotational speed detection portion 10, and it is determined in Step S103 whether the rotational speed N exceeds the set value Ns. When it is determined that the rotational speed N does not exceed the set value Ns, the process proceeds to Step S104, and the on-command is kept generated to maintain the transistor Tr4 in an on-state. Then in Step S105, other processings required for controlling the ignition position or the like are performed, then returning to Step S102. When it is determined in Step S103 that the rotational speed N exceeds the set value Ns, an off-command that commands to turn off the transistor Tr4 is generated in Step S106, then proceeding to Step S105.

According to the algorithm in FIG. 5, ignition timing arithmetical operation means is comprised by Step S102, and the rotational speed determination means is comprised by Step S103. On/off-command generation means is comprised by the process of generating the on-command in Step S101, Step S104 and Step 106, and the switch control portion 11A is comprised of the rotational speed determination means and the on/off-command generation means.

When cranking of the engine is performed in the ignition device in FIG. 1, an AC voltage is induced in the exciter coil 1. The transistor Tr1 that constitutes the voltage increasing switch 15 becomes an on-state in a positive half cycle of the AC voltage, and thus a short-circuit current passes from the exciter coil 1 through the transistor Tr1 and the first and second shunt resistors R4 and R9.

When the rotational speed of the engine is extremely low, the output voltage of the positive half cycle of the exciter coil 1 is low, and the voltage across the shunt resistor R4 cannot reach the trigger level before the output voltage reaches its peak value. Thus, when the output voltage of the positive half cycle of the exciter coil 1 reaches the peak value to turn on the transistor Tr3, the trigger signal is provided to the thyristor Th2 to turn on the thyristor. Thus, the transistor Tr1 is interrupted to interrupt the short-circuit current of the exciter coil having passed until then, and thus a high voltage of 200 V or more is induced in the exciter coil 1, and the ignition capacitor 4 is charged with the voltage. When the ignition control portion 9 provides the ignition signal Vi to the thyristor Th1 at ignition timing of the engine, the thyristor Th1 becomes the on state, and the charges in the ignition capacitor 4 are discharged through the thyristor Th1 and the primary coil 3*a* of the ignition coil. This discharge causes a high voltage for ignition to be induced in the secondary coil 3*b* of the ignition coil, and the high voltage is applied to the ignition plug 12, thus spark discharge occurs in the ignition plug 12 to ignite the engine. When this causes an initial explosion of the engine, the engine is started.

When the engine is started and then the rotational speed thereof increases, the induced voltage of the exciter coil 1 is increased, and the voltage across the first shunt resistor R4 finally reaches the trigger level of the thyristor Th2 before the output voltage Vep of the positive half cycle of the exciter coil reaches its peak. When the voltage across the first shunt resistor R4 reaches the trigger level, the thyristor Th2 that constitutes the interruption control switch is turned on, and the thyristor bypasses the base current of the transistor Tr1 from the transistor, and thus the transistor Tr1 is interrupted to induce a high voltage in the exciter coil 1. The ignition capacitor 4 is charged by the voltage, and thus the ignition operation is performed in the same manner as described above.

In the embodiment, when the rotational speed of the engine is the set value Ns or less (during low speed rotation), the transistor Tr4 that constitutes the resistance value changeover switch is turned on, and the second shunt resistor R9 is connected in parallel across the first shunt resistor R4. When the second shunt resistor R9 is connected in parallel across the first shunt resistor R4, the voltage across the first shunt resistor R4 cannot reach the trigger level unless a higher current than a current that causes the voltage across the first shunt resistor R4 to reach the trigger level in separation of the second shunt resistor R9 from the first shunt resistor passes through the voltage increasing switch 15, and thus an apparent trigger level of the interruption control switch 16 can be increased to increase a current interruption value in the interruption of the voltage increasing switch 15. Thus, the voltage induced in the exciter coil during low speed rotation of the engine can be increased to charge the ignition capacitor to a sufficiently high voltage, thereby increasing ignition performance during low speed rotation and increasing startability of the engine and stability of rotation during low speed rotation.

When the rotational speed of the engine exceeds the set value Ns, the transistor Tr4 is turned off, and thus the second shunt resistor R9 is separated from the first shunt resistor R4. When the second shunt resistor R9 is separated from the first shunt resistor R4, a current required to be passed through the voltage increasing switch 15 for causing the voltage generated across the first shunt resistor R4 to reach the trigger level can be made lower than in the case where the second shunt resistor R9 is connected in parallel with the first shunt resistor R4. Thus, during middle and high speed rotation of the engine, the apparent trigger level of the interruption control switch 16 can be reduced to limit the current interruption value in the interruption of the voltage increasing switch 15, thereby preventing an increase in the voltage induced in the exciter coil and preventing the charging voltage of the ignition capacitor 4 from becoming excessive. When the voltage induced in the exciter coil is limited during middle and high speed rotation of the engine, an excess output of the exciter coil is not short-circuited, thereby preventing wasting energy and preventing overcharge of the ignition capacitor.

As in the embodiment, if the peak trigger circuit 17 is provided that provides the trigger signal to the interruption control switch 16 when the output voltage Vep of the positive half cycle of the exciter coil reaches its peak, the short-circuit current of the exciter coil is interrupted when the rotational speed of the engine is extremely low and the set value or less, and the output voltage of the positive half cycle of the exciter coil 1 reaches its peak. Thus, when the rotational speed of the engine is extremely low, an interruption value of the short-circuit current can be increased to increase the voltage induced in the exciter coil. Thus, the ignition capacitor can be charged to a sufficiently high voltage to increase ignition performance and increase startability of the engine during extremely low speed rotation.

Figure 2:
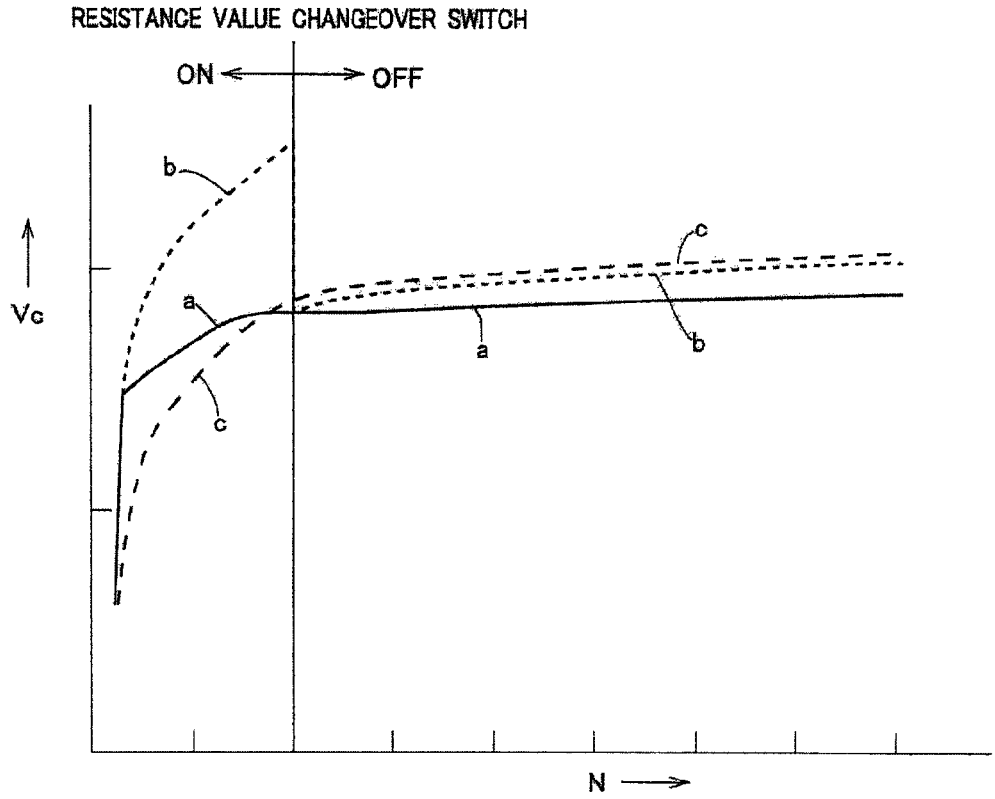
FIG. 2 shows characteristic curves showing a charging voltage to rotational speed characteristic obtained by the embodiment of the present invention as compared with a charging voltage to rotational speed characteristic obtained by a conventional ignition device.

FIG. 2 shows an example of the relationship between the voltage Vc across the ignition capacitor 4 and the rotational speed N of the engine in the capacitor discharge ignition device including the voltage increasing circuit. In FIG. 2, the solid curve a shows a characteristic of the case without the voltage increasing control portion 11, and the short broken curve b shows a characteristic obtained by the ignition device in the embodiment. This shows that the charging voltage Vc of the ignition capacitor can be increased to increase ignition performance and increase startability of the engine and stability during low speed rotation in an area where the rotational speed of the engine is the set value Ns or less. The long broken curve c in FIG. 2 shows a characteristic of the case without the voltage increasing control portion 11 and the peak trigger circuit 17. For the characteristic of the curve c, the ignition capacitor is insufficiently charged during low speed rotation of the engine to reduce ignition performance, thereby inevitably reducing startability of the engine.

In the above described embodiment, the ignition capacitor 4 is connected in series with the primary coil of the ignition coil, but the present invention may be, of course, applied to a capacitor discharge ignition device of the type in which an ignition capacitor 4 is connected in parallel with a primary coil of the ignition coil.

In the above described embodiment, the thyristor is used as the interruption control switch 16, but the switch may be comprised of a switch element other than the thyristor. In the above described embodiment, the transistor Tr1 is used as the voltage increasing switch 15, but the switch may be on while receiving the drive signal, and a different switch element such as an MOSFET that can be controlled on/off may be used as the voltage increasing switch.

In the above described embodiment, the voltage increasing switch drive circuit is comprised so as to provide the drive signal from the power supply circuit 7 to the voltage increasing switch 15, but the voltage increasing switch drive circuit may be comprised so as to provide the drive signal from the exciter coil 1 to the voltage increasing switch 15.

Although the preferred embodiment of the invention has been described and illustrated with reference to the accompanying drawings, it will be understood by those skilled in the art that it is by way of examples, and that various changes and modifications may be made without departing from the spirit and scope of the invention, which is defined only to the appended claims.

What is claimed is:

1. A capacitor discharge ignition device for an engine comprising:

an exciter coil provided in a magneto generator driven by the engine;

a voltage increasing circuit that increases an output voltage of one half cycle of said exciter coil;

an ignition capacitor charged by an output voltage of said voltage increasing circuit;

a capacitor discharge switch that which becomes an on-state when receiving an ignition signal and discharges charges in said capacitor through a primary coil of an ignition coil; and an ignition control portion that provides an ignition signal to said capacitor discharge switch at ignition timing of said engine, wherein said voltage increasing circuit includes:

a voltage increasing switch that is comprised of a switch element that can be an on-state while receiving a drive signal, is connected in parallel with said exciter coil, and is turned on to pass a short-circuit current through said exciter coil when said exciter coil generates said output voltage of one half cycle;

a voltage increasing switch drive circuit that provides said drive signal to said voltage increasing switch;

a first shunt resistor for current detection connected in series with said voltage increasing switch;

an interruption control switch that is provided so as to allow said drive signal to be provided to said voltage increasing switch when the interruption control switch is in an off-state and bypass said drive signal from said voltage increasing switch to interrupt said voltage increasing switch when the interruption control switch is in an on-state, and receives a trigger signal and is turned on when a voltage across said first shunt resistor reaches a set trigger level;

a second shunt resistor connected in parallel across said first shunt resistor through a resistance value changeover switch; and a switch control portion that controls said resistance value changeover switch so as to maintain said resistance value changeover switch in an on-state when a rotational speed of said engine is a set value or less, and maintain said resistance value changeover switch in an off-state when said rotational speed exceeds said set value.

2. The capacitor discharge ignition device for an engine according to claim 1, further comprising a peak trigger circuit that provides a trigger signal to said interruption control switch when said output voltage of one half cycle of said exciter coil reaches its peak.

3. The capacitor discharge ignition device for an engine according to claim 1, wherein said voltage increasing switch drive circuit is comprised so as to provide a drive signal from a power supply circuit that converts the output voltage of said exciter coil into a certain DC voltage to said voltage increasing switch.

4. The capacitor discharge ignition device for an engine according to claim 1, wherein said voltage increasing switch drive circuit is comprised so as to provide a drive signal from said exciter coil to said voltage increasing switch.

5. The capacitor discharge ignition device for an engine according to claim 1, wherein a switch element that constitutes said voltage increasing switch is comprised of a transistor.

6. The capacitor discharge ignition device for an engine according to claim 1, wherein a switch element that constitutes said voltage increasing switch is comprised of an MOSFET.

7. The capacitor discharge ignition device for an engine according to claim 1, wherein said resistance value changeover switch is comprised of a transistor, a rotational speed detection portion is provided that detects a rotational speed of the engine from an output pulse of a signal generator mounted to said engine, and said switch control portion is comprised so as to supply a base current to the transistor that constitutes said resistance value changeover switch when said rotational speed detection portion detects that the rotational speed of the engine is a set value or less, and stop supplying the base current to the transistor that constitutes said resistance value changeover switch when said rotational speed detection portion detects that the rotational speed of the engine exceeds the set value.

* * * * *

UNITED STATES PATENT AND TRADEMARK OFFICE

CERTIFICATE OF CORRECTION

PATENT NO. : 7,631,633 B2
APPLICATION NO. : 11/836888
DATED : December 15, 2009
INVENTOR(S) : Kouji Sasaki It is certified that error appears in the above-identified patent and that said Letters Patent is hereby corrected as shown below:

In column 5, line 66, please delete the number "10" after the word -the- and before the word -ground- Signed and Sealed this Twenty-second Day of June, 2010

David J. Kappos

David J. Kappos
*Director of the United States Patent and Trademark Office*